US005404731A

United States Patent [19]

Traub

[11] Patent Number: 5,404,731

[45] Date of Patent: Apr. 11, 1995

[54] PLAY ASSEMBLY AND METHOD FOR MAKING AN ITEM OF JEWELRY

[75] Inventor: Jo Ann M. Traub, West Warwick, R.I.

[73] Assignee: Hasbro, Inc., Pawtucket, R.I.

[21] Appl. No.: 194,106

[22] Filed: Feb. 8, 1994

[51] Int. Cl.[6] ..... A44C 17/00

[52] U.S. Cl. ..... 63/32; 63/15; 63/26; 446/26

[58] Field of Search ..... 63/26, 32, 15, DIG. 3; 426/90, 104, 132; 446/26, 85, 71

[56] References Cited

U.S. PATENT DOCUMENTS 294,575 3/1884 Britton .
1,080,971 12/1913 Isaacs .
2,030,126 2/1936 Vogt .
2,092,273 9/1937 Cosler .
2,469,589 5/1949 Barricini .
3,085,883 4/1963 Collier .
3,165,821 1/1965 Breton ..... 63/32
4,663,175 5/1987 Werner et al. .
5,133,792 7/1992 Purohit et al. ..... 134/26
5,302,403 4/1994 Cook et al. ..... 426/104

*Primary Examiner*—Michael J. Milano
*Attorney, Agent, or Firm*—Kurt R. Benson

[57] ABSTRACT

A play assembly for making an item of jewelry includes a gem setting and an imitation unfinished stone comprising an imitation finished gemstone and an irregularly-shaped, water soluble, outer coating on the imitation, finished gemstone. The play assembly is adapted for use in a method wherein a child dissolves the outer coating from the unfinished stone to reveal the finished gemstone and then assembles the finished gemstone in the setting.

10 Claims, 2 Drawing Sheets

PLAY ASSEMBLY AND METHOD FOR MAKING AN ITEM OF JEWELRY

BACKGROUND OF THE SUMMARY OF THE INVENTION

The instant invention relates to ornamental jewelry and more particularly to a play assembly and method for finishing an unfinished artificial stone into a finished gemstone and for assembling the finished gemstone in a jewelry setting.

Articles of ornamental jewelry, including those which include artificial gemstones, have been found to have relatively high levels of popularity among young children. Further, it has been found that kits and the like, which enable young children to assemble ornamental jewelry items from various components, frequently have significant levels of play value and can be important in the development of both artistic and mechanical skills. However, the heretofore available methods and apparatus for forming jewelry items, which have comprised artificial gemstones, have generally included fully finished artificial gemstones which are ready for assembly with various settings. Hence, the heretofore available apparatus and methods have generally not been adapted to enable young children to form finished gemstones from simulated raw unfinished stones.

The instant invention provides an interesting and effective method and apparatus which enables a child to form a finished, artificial, cut gemstone from a simulated, ruff, irregularly-shaped, uncut stone or rock and to thereafter assemble the finished gemstone with a gem setting. Specifically, the instant invention provides an effective, simulated, ruff, uncut stone comprising an imitation finished gemstone and a water soluble outer coating on the finished gemstone which covers the finished gemstone and imparts an appearance thereto resembling that of a natural unfinished stone or rock. The water soluble coating preferably comprises a sugar-based water soluble coating, containing a taste detracting component such as alum, which has been applied to the artificial finished gemstone in a pan coating process so as to produce an unfinished artificial stone or rock. More specifically, the outer coating is preferably applied so as to impart a ruff, irregular, uncut and unfinished appearance to the unfinished artificial stone or rock. Accordingly, a child can carry out the method of the subject invention by immersing the imitation unfinished stone or rock in a quantity of water to dissolve the outer coating thereon and to reveal the true appearance of the initially concealed imitation, finished gemstone. Thereafter, the imitation finished gemstone can be assembled in a setting to produce a jewelry item which includes the imitation finished gemstone.

Accordingly, it is a primary object of the instant invention to provide a play assembly comprising a simulated natural unfinished stone or rock which can be readily and easily processed by a child to reveal an imitation finished gemstone.

Another object of the instant invention is to provide a simulated unfinished stone or rock comprising an imitation finished gemstone and a water soluble outer coating on the finished gemstone which imparts a natural, unfinished appearance to the simulated unfinished stone or rock.

An even still further object of the instant invention is to provide a play assembly which enables a child to first refine or finish a stone or rock and to then assemble the finished gemstone in a jewelry setting.

And even still further object of the instant invention is to provide an effective method which enables a child to first form a finished gemstone from an artificial, natural, unfinished stone or rock and to then form a jewelry item which includes the finished gemstone.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
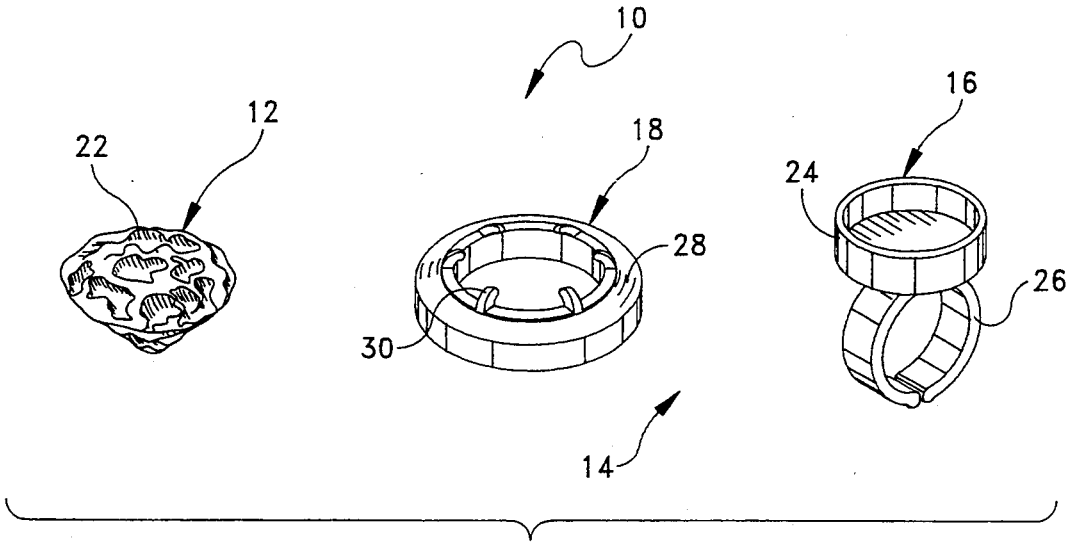
FIG. 1 is a perspective view of the play assembly of the subject invention.
Figure 2:
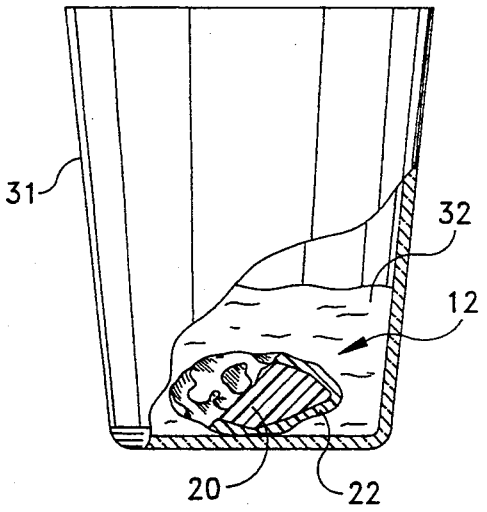
FIGS. 2 and 3 are fragmentary side elevational views illustrating the method of forming a finished imitation gemstone in accordance with the method of the subject invention.
Figure 3:
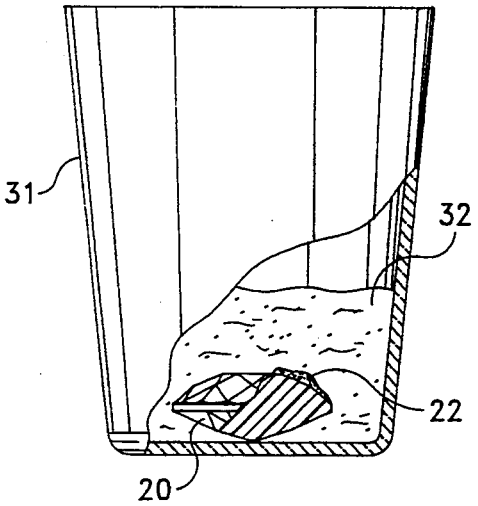
Figure 4:
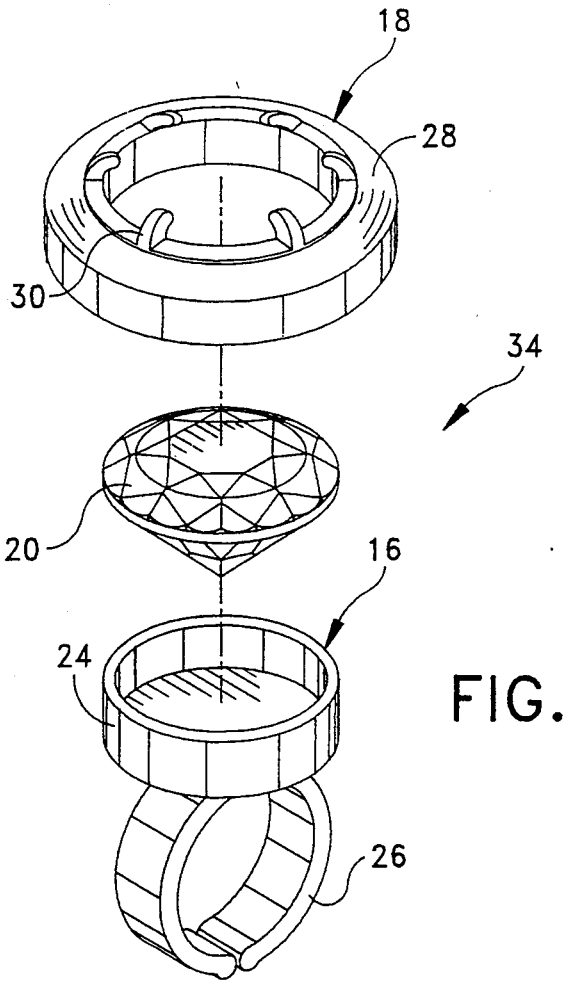
FIG. 4 is an exploded perspective view of a jewelry item comprising a gemstone formed in accordance with the method.

Referring now to the drawings, the play assembly of the instant invention is illustrated in FIG. 1 and generally indicated at 10. The play assembly 10 comprises a simulated, unfinished, natural stone or rock generally indicated at 12 and a gem setting generally indicated at 14 including a setting base generally indicated at 16 and a retaining ring generally indicated at 18. The simulated unfinished rock 12 is adapted to be readily and easily processed by a child to form an imitation finished gemstone, and the setting 14 is adapted for receiving and mounting the finished gemstone in the manner illustrated in FIG. 4.

The simulated unfinished natural stone or rock 12 comprises a finished imitation cut gemstone 20 having an outer coating 22 thereon which is adapted to impart a ruff, uncut, unfinished, natural appearance to the unfinished rock 12. The finished gemstone 20 preferably comprises an imitation gemstone which is made from a suitable plastic material in a conventional cut gemstone configuration, although it will be understood that the finished gemstone 20 could alternatively be formed in an uncut, smooth polished configuration or as a simulated refined or manufactured element of high value. The outer coating 22 comprises a water soluble coating which is applied to the finished imitation gemstone 20 in a manner so as to impart the appearance of a natural, unfinished, uncut stone to the unfinished rock 12. In this regard, the coating 22 is preferably made from a water soluble material, and it is preferably applied to the finished imitation gemstone 20 in a pan coating process. More specifically, the coating 22 preferably comprises a sugar-based material which includes one or more taste detracting components, such as salt and/or alum, to make the simulated unfinished gem 12 less tolerable to the taste of a child and therefore less likely to be eaten or swallowed. The coating 22 preferably comprises 86% sugar, 11% alum and 3% salt, although various other formulations can also be utilized for the coating 22. In any event, it is important that the coating 22 is readily soluble in water so that it can be removed from the finished gemstone 20 when desired by immersing the unfinished rock 12 in a quantity of water. The coating 22 is preferably applied to the finished gem 20 in a conventional pan coating process wherein the coating 22 is applied in a melted condition. Preferably, however, the coating 22 is applied using a heated aqueous sugar solution containing only a minimal quantity of water so that the sugar solidifies into a lumpy or irregular layer of the coating 22 as the water evaporates.

The gem setting 14 is essentially of conventional configuration, and it includes the base portion 16 comprising a gem receiving support ring portion 24 having a finger ring portion 26 thereon. The base portion 16 is preferably made from a suitable plastic material, and it is dimensioned for receiving the finished gemstone 20 therein in a conventional manner. The upper or retaining ring portion 18 comprises a main ring portion 28 having a plurality of inwardly extending retaining fingers 30 thereon. The retaining ring portion 18 is adapted to be received on and secured to the base portion 16 in order to retain the finished gemstone 20 thereon. The retaining ring portion 18 is also preferably made from a suitable plastic material.

In accordance with the method of the subject invention the coating 22 is removed from the finished gemstone 20 by placing the unfinished, simulated, natural rock 12 in a container 31 of water 32. The rock 12 is preferably left in the water 32 until all of the coating 22 has been removed from the finished gemstone 20. This may be accomplished by either leaving the rock 12 in the water 32 for an extended period of time or by agitating the water 32 in a conventional manner. In any event, once the coating 22 has been dissolved into the water 32, the finished gemstone 20 can be removed from the water 32, and it is preferably rinsed and dried. The finished gemstone 20 is then assembled with the setting 14 in the manner illustrated in FIG. 4 to provide a finished finger ring assembly generally indicated at 34 which includes the finished gemstone 20.

Figure 5:
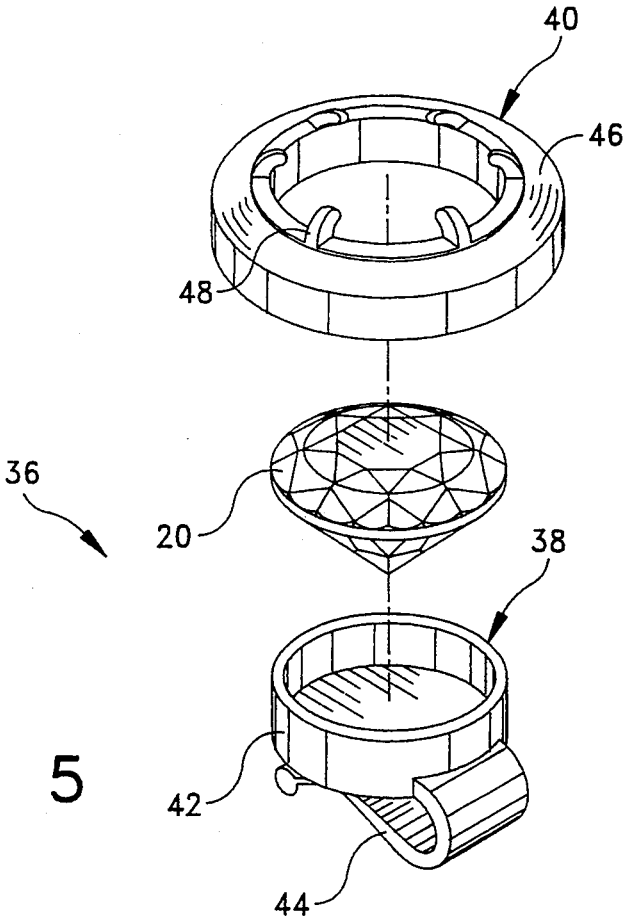
FIG. 5 is an exploded perspective view of another jewelry item comprising a gemstone formed in accordance with the method.

As an alternative to the above, as illustrated in FIG. 5, the finished gemstone 20 can be assembled with a different setting 36 comprising a base portion 38 and upper retaining ring portion 40. The base portion 38 includes a receiving ring portion 42 and a clip portion 44, and it is also dimensioned for receiving the gemstone 20 therein. The retaining ring portion 40 includes a main ring portion 46 having a plurality of integrally formed, inwardly, extending retaining fingers 48 thereon.

It is seen therefore that the instant invention provides an effective play assembly and method for forming imitation gemstones and jewelry items which include imitation gemstones. The method requires a child to transform a simulated, natural, unfinished rock into a finished gemstone before the finished gemstone can be assembled with a gem setting, and accordingly, the method has a significantly enhanced play value. Hence it is seen that the play assembly and method of the instant invention represent significant advancements in the toy art which have substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A play assembly for making an item of jewelry which includes an artificial gemstone, said play assembly comprising:

a. an imitation, unfinished stone including an imitation, finished, unmounted, artificial gemstone and a normally hardened water soluble outer coating on said finished, unmounted, artificial gemstone, said outer coating covering said finished, unmounted, artificial gemstone and imparting an appearance to said unfinished, artificial stone resembling that of a natural, unfinished stone; and b. a gem setting dimensioned for receiving and mounting said finished, unmounted, artificial gemstone therein to form said item of jewelry after the removal of said outer coating from said finished, unmounted, artificial gemstone.

2. In the play assembly of claim 1, said outer coating comprising a water soluble pan coating which has been applied to said finished, unmounted, artificial gemstone so as to produce a roughened, irregular surface on said unfinished artificial stone.

3. In the play assembly of claim 2, said outer coating comprising a water soluble sugar-based pan coating.

4. In the play assembly of claim 1, said finished gemstone comprising a finished, unmounted, artificial, cut gemstone, said outer coating being applied to said finished, unmounted, artificial, cut gemstone so as to provide a rough, irregular, uncut, unfinished appearance on said unfinished stone.

5. An unfinished artificial stone comprising an imitation, finished, unmounted, artificial gemstone and a normally hardened water soluble outer coating on said finished, unmounted, artificial gemstone, said outer coating covering said finished gemstone and having an appearance and outer configuration resembling that of an unfinished stone.

6. In the unfinished artificial stone of claim 5, said outer coating comprising a water soluble pan coating which has been applied to said imitation, finished, unmounted, artificial gemstone so as to produce a roughened, irregular surface on said unfinished artificial stone.

7. In the unfinished artificial stone of claim 6, said outer coating comprising a water soluble sugar-based pan coating.

8. In the unfinished artificial stone of claim 5, said finished gemstone comprising an imitation, finished, unmounted, artificial cut gemstone, said outer coating having a rough, irregular, uncut, configuration so as to impart an unfinished appearance to said unfinished, artificial stone.

9. A method refining and finishing an unfinished artificial stone, said unfinished artificial stone comprising an imitation, finished, unmounted, artificial gemstone and a normally hardened water soluble outer coating on said finished, unmounted, artificial gemstone, said outer coating covering said finished, unmounted, artificial gemstone and imparting an appearance thereto resembling that of an irregularly-shaped, unfinished stone, said method comprising dissolving said outer coating in water to reveal said imitation finished, unmounted, artificial gemstone.

10. A method of making an item of jewelry which includes an artificial gemstone comprising dissolving an outer coating from an unfinished artificial stone, said unfinished artificial stone comprising an imitation finished, unmounted, artificial gemstone having said outer coating thereon, said outer coating being normally hardened but being water soluble and covering said imitation, finished, unmounted artificial gemstone, said outer coating having a rough, irregularly shaped configuration and imparting an appearance to said unfinished, artificial stone resembling that of an unfinished, natural stone, said outer coating being dissolvable in water to reveal said imitation finished, unmounted, artificial gemstone; and thereafter mounting said imitation finished, unmounted, artificial gemstone in a setting.

* * * * *